US007097545B2

(12) United States Patent
Lee et al.

(10) Patent No.: US 7,097,545 B2
(45) Date of Patent: Aug. 29, 2006

(54) POLISHING PAD CONDITIONER AND CHEMICAL MECHANICAL POLISHING APPARATUS HAVING THE SAME

(75) Inventors: Jong-Won Lee, Sungnam-si (KR); Joon-Sang Park, Seoul (KR); Chang-Ki Hong, Sungnam-si (KR)

(73) Assignee: Samsung Electronics Co., Ltd., (KR)

( * ) Notice: Subject to any disclaimer, the term of this patent is extended or adjusted under 35 U.S.C. 154(b) by 0 days.

(21) Appl. No.: 10/985,206

(22) Filed: Nov. 10, 2004

(65) Prior Publication Data

US 2005/0113009 A1 May 26, 2005

(30) Foreign Application Priority Data

Nov. 24, 2003 (KR) ..... 10-2003-0083417

(51) Int. Cl.
*B24B 53/00* (2006.01)

(52) U.S. Cl. ..... 451/72; 451/443

(58) Field of Classification Search ..... 451/56, 451/72, 443, 444, 287, 288, 5
See application file for complete search history.

(56) References Cited

U.S. PATENT DOCUMENTS 5,456,627 A * 10/1995 Jackson et al. ..... 451/11
5,782,675 A * 7/1998 Southwick ..... 451/56
5,857,898 A * 1/1999 Hiyama et al. ..... 451/56
5,941,762 A * 8/1999 Ravkin et al. ..... 451/56
6,893,336 B1 * 5/2005 Jin ..... 451/443

* cited by examiner

*Primary Examiner*—Robert A. Rose
(74) *Attorney, Agent, or Firm*—F. Chau & Associates LLC

(57) ABSTRACT

Chemical mechanical apparatuses including a polishing pad conditioning unit for improving a conditioning rate and wear uniformity of a polishing pad are provided. In one aspect, a chemical mechanical polishing apparatus includes a polishing pad conditioner including conditioning disks disposed in a radial direction of a planarizing surface of a circular polishing pad and contacted with the planarizing surface of the circular polishing pad during rotation of the circular polishing pad. The conditioning disks are connected to first drive units supported by an arm disposed over the circular polishing pad and extended in a radial direction of a planarizing surface of the circular polishing pad. The arm is connected to second drive units. The second drive units move the arm horizontally and reciprocally in the radial direction of the planarizing surface of the circular polishing pad. Thus, a conditioning rate and wear uniformity of the polishing pad may be improved.

16 Claims, 3 Drawing Sheets

POLISHING PAD CONDITIONER AND CHEMICAL MECHANICAL POLISHING APPARATUS HAVING THE SAME

CROSS REFERENCE TO RELATED APPLICATION

This application claims priority to Korean Patent Application No. 2003-83417, filed on Nov. 24, 2003, which is incorporated herein by reference in its entirety.

BACKGROUND OF THE INVENTION

1. Field of the Invention

The present invention relates, generally, to a polishing pad conditioner and a chemical mechanical polishing apparatus having the polishing pad conditioner. More particularly, the present invention relates to a polishing pad conditioner of a chemical and mechanical polishing apparatus that is used for planarizing a surface of a semiconductor substrate.

2. Description of the Related Art

To meet various demands of consumers, technologies for manufacturing semiconductor devices have been developed to improve the quality, e.g., integration degree, reliability, response speed, etc., of semiconductor devices. Generally, a semiconductor device is manufactured using multiple processes including deposition, photolithography, etching, implantation, and polishing processes, etc. The polishing process plays an important role to improve structural stability and electrical characteristics of the semiconductor device. And consequently, planarizing has become increasingly more important.

In general, a chemical mechanical polishing (CMP) process is widely used to planarize a surface of a layer formed on the semiconductor substrate. The CMP process uses both chemical reactions between a slurry and the surface of the layer and mechanical frictions between a circular polishing pad and the surface of the layer to planarize the surface of the layer formed on the semiconductor substrate.

A CMP apparatus for carrying out the CMP process includes a circular polishing pad disposed on a polishing table, a polishing head for holding and rotating the semiconductor substrate, a slurry supply unit for supplying the slurry at an interface between a surface of the semiconductor substrate and a planarizing surface of the circular polishing pad, a polishing pad conditioner for improving conditions of the planarizing surface of the circular polishing pad, etc. The CMP apparatus may also include an endpoint detector for detecting an endpoint of the CMP process.

The slurry is a carrier including abrasives and chemical materials used for polishing the surface of the semiconductor substrate. A polishing rate is an important variable in the CMP process that uses the slurry. The polishing rate may be determined in accordance with the type of slurry used in the CMP process. One factor in determining the polishing rate in the CMP process may be the diameter of the abrasive in the slurry, which may be about 10 Å to about 1000 Å. The hardness of the abrasive may also be used in determining the polishing rate in the CMP process. For instance, the hardness of the abrasive may be substantially equal to that of the surface of the semiconductor substrate.

A plurality of grooves in which the slurry flows is formed in concentric circles at the planarizing surface portion of the circular polishing pad. A plurality of micro pores is also formed at the planarizing surface portion of the circular polishing pad to receive the slurry therein.

The circular polishing pad is classified into two groups. One is a soft circular polishing pad and the other is hard circular polishing pad. The soft pad is a felt pad including urethane. The hard circular polishing pad is a porous urethane pad.

In a case where the semiconductor substrate is polished by a CMP process using the circular polishing pad and the slurry, micro pores are often filled with byproducts that are generated during the CMP process. Thus, a conditioning process for removing the byproducts from the micro pores may be required. The conditioning process may be performed simultaneously with the CMP process. Alternatively, the conditioning process of the circular polishing pad may be independently performed after the CMP process.

As an example of the circular polishing pad conditioner, a convex shaped polishing pad conditioner including nickel alloy is disclosed in U.S. Pat. No. 6,325,709 B1 issued Nanda, et al. Diamond abrasives attached to a lower face of the polishing pad conditioner contact a planarizing surface of a circular polishing pad.

In addition, a polishing pad conditioner comprising a conditioning element that includes a body and a bonding medium composed of nickel or, another metal, wherein the nickel layer is attached to a lower face of the body and diamond particles attached to a lower face of the bonding medium is disclosed in U.S. Pat. No. 6,361,413 B1 issued Skrovan.

The polishing pad conditioner for performing the conditioning process includes a conditioning disk. The diamond particles are attached to a lower face of a conditioning disk. The lower face of the conditioning disk contacts the planarizing surface of the circular polishing pad. The conditioning disk is then rotated and moved across the planarizing surface of the circular polishing pad during the conditioning process, thereby improving conditions of the planarizing surface of the circular polishing pad.

As a diameter of a wafer that is used as a semiconductor substrate is increased, a diameter of the conditioning disk is also increased. However, although a conditioning rate of the circular polishing pad is increased in proportion to an increase of the diameter of the conditioning disk, a pad wearing uniformity may decrease. In contrast, although the pad wearing uniformity is increased in proportion to a decrease of the diameter of the conditioning disk, the conditioning rate of the circular polishing pad may also decrease. Accordingly, to overcome the above-mentioned problems, an improved polishing pad conditioner is required.

SUMMARY OF THE INVENTION

In general, exemplary embodiments of the present invention include a polishing pad conditioner for increasing the conditioning rate and the pad wearing uniformity, as well as a CMP apparatus having a polishing pad conditioner.

In accordance with an exemplary embodiment of the present invention, a polishing pad conditioner includes a plurality of conditioning disks, a plurality of first drive units, and an arm. The conditioning disks are disposed in a radial direction of a planarizing surface of a circular polishing pad and contact the planarizing surface of the circular polishing pad. The first drive units are connected to the conditioning disks to rotate the conditioning disks. The arm for supporting the first drive units is disposed over the circular polishing pad and is extended in the radial direction of the planarizing surface of the circular polishing pad.

In accordance with an exemplary embodiment of the present invention, diamond particles are attached on a contact surface of each of the conditioning disks using an adhesive or an electroplating process.

The polishing pad conditioner further includes a plurality of disk holders, a plurality of first shafts, a plurality of second shafts and a plurality of air bladders. The disk holders hold the conditioning disks. The first shafts are connected to the disk holders. The second shafts are connected to the first drive units. The air bladders are connected between the first shafts and the second shafts to adjust intervals between the conditioning disks and the circular polishing pad.

The polishing pad conditioner includes a second drive unit connected to the arm. The second drive unit moves the arm in a radial direction of the planarizing surface of the circular polishing pad and in a direction substantially perpendicular to the radial direction of the planarizing surface of the circular polishing pad. Preferably, the second drive unit includes a Cartesian coordinates robot. Alternatively, the second drive unit may include a selective compliance assembly robot arm (SCARA) robot.

In addition, the polishing pad conditioner further includes a control unit connected to the first drive units and the air bladders. The control unit controls a volume of air within each of the air bladders to adjust the intervals between the conditioning disks and the circular polishing pad. The control unit also controls revolutions per minute (RPM) of the conditioning disks to adjust a local wearing rate of the polishing pad.

In accordance with another exemplary embodiment of the present invention, a CMP apparatus includes a polishing table, a polishing head, a slurry supply unit and a polishing pad conditioner.

A circular polishing pad for polishing a surface of a substrate is attached on the polishing table. The polishing head holds the substrate and orients a surface of the substrate to be polished over a planarizing surface of the circular polishing pad. The polishing head contacts the surface of the substrate with the planarizing surface of the polishing pad during a polishing process. The slurry supply unit supplies slurry at an interface between the surface of the substrate to be polished and the planarizing surface of the circular polishing pad during the polishing process.

The polishing pad conditioner includes a plurality of conditioning disks, a plurality of drive units and an arm. The conditioning disks are disposed in a radial direction of a planarizing surface of a circular polishing pad and contact the planarizing surface of the circular polishing pad. The drive units for rotating the conditioning disks are connected to the conditioning disks. The arm for supporting the drive unit is disposed over the polishing pad and is extended along the radial direction of the surface of the circular polishing pad.

In addition, the CMP apparatus further includes a deionized water supply unit disposed adjacent to the polishing pad conditioner. The deionized water supply unit supplies deionized water at interfaces between the contact surfaces of the conditioning disks and the planarizing surface of the circular polishing pad. The deionized water supply unit includes a plurality of nozzles for supplying the deionized water at the interfaces between the contact surfaces of the conditioning disks and the planarizing surface of the circular polishing pad.

According to the present invention, the conditioning disks disposed in the radial direction of the planarizing surface of the circular polishing pad contact the planarizing surface of the circular polishing pad. In addition, the circular polishing pad and the conditioning disk rotate during a conditioning process. Thus, a conditioning rate of the polishing pad conditioner and wear uniformity of the polishing pad may be improved together.

These and other exemplary embodiments, features, aspects, and advantages of the present invention will be described and become more apparent from the detailed description of exemplary embodiments when read in conjunction with the drawings.

DETAILED DESCRIPTION OF EXEMPLARY EMBODIMENTS

The present invention now will be described more fully hereinafter with reference to the accompanying drawings, in which embodiments of the invention are shown.

Figure 1:
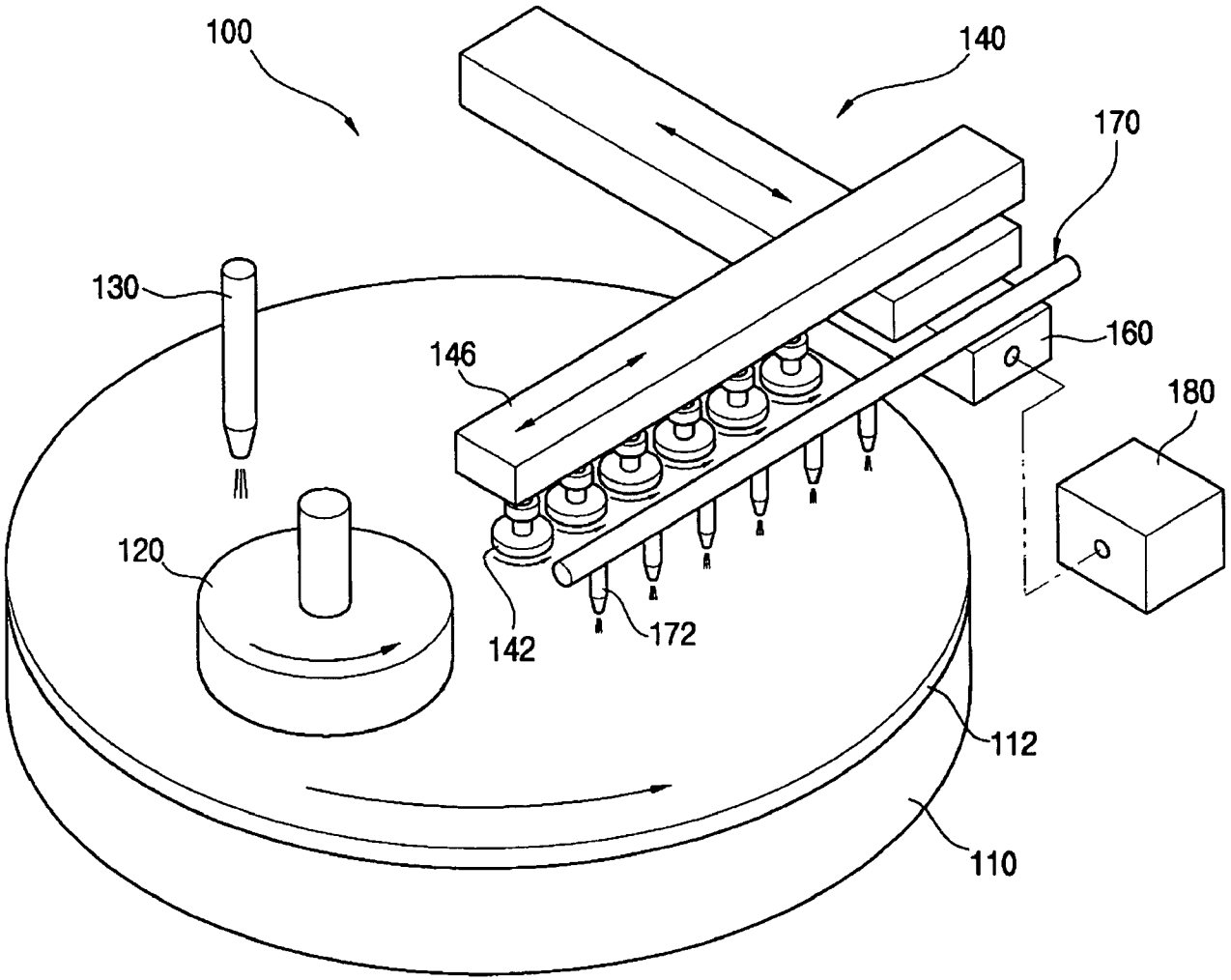
FIG. 1 is a perspective view illustrating a CMP apparatus in accordance with an exemplary embodiment of the present invention.
Figure 2:
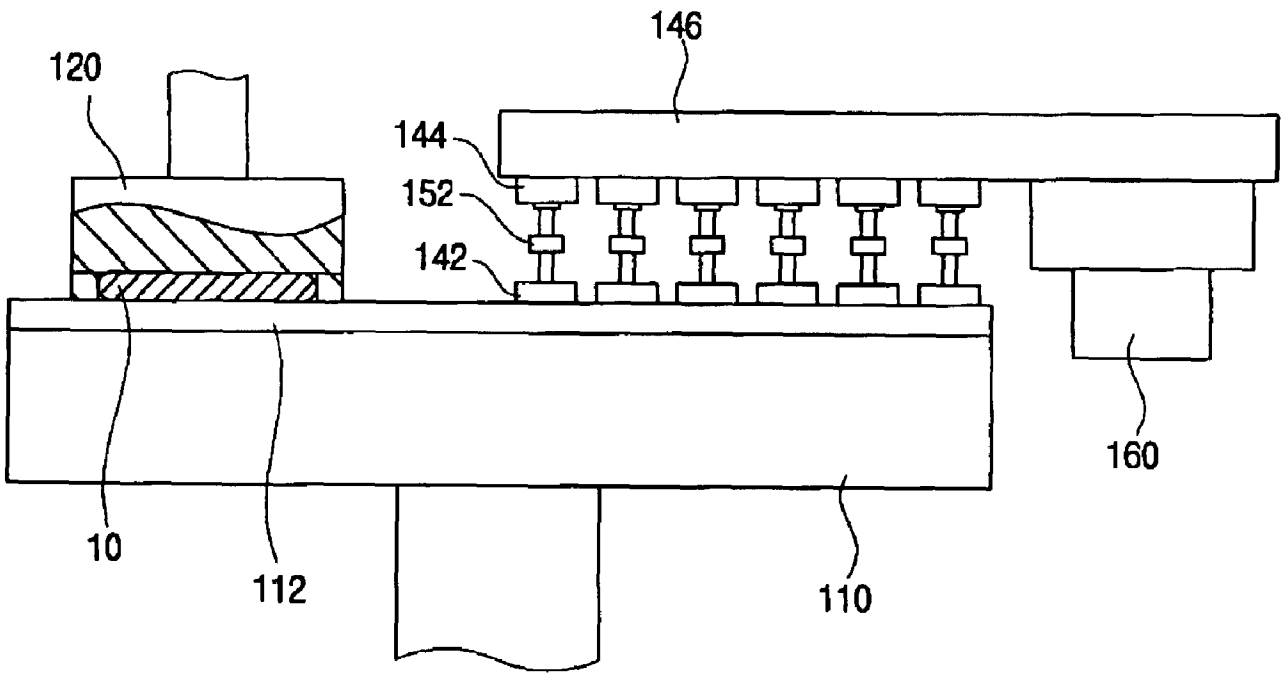
FIG. 2 is a front view illustrating the CMP apparatus shown in FIG. 1.
Figure 3:
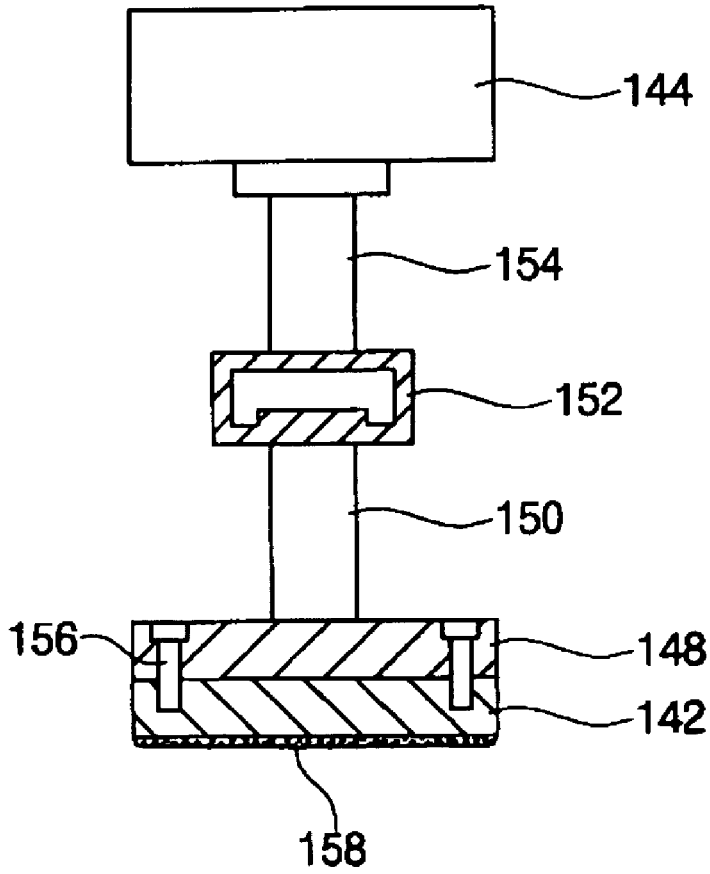
FIG. 3 is a cross-sectional view illustrating a conditioning disk of a polishing pad conditioner shown in FIG. 1.

FIG. 1 is a perspective view illustrating a CMP apparatus in accordance with an exemplary embodiment of the present invention. FIG. 2 is a front view illustrating the CMP apparatus shown in FIG. 1. FIG. 3 is a cross-sectional view illustrating a conditioning disk of a polishing pad conditioner shown in FIG. 1.

Referring to FIGS. 1 and 3, a CMP apparatus 100 in accordance with an exemplary embodiment of the present invention includes a polishing table 110, a polishing head 120, a slurry supply unit 130 and a polishing pad conditioner 140.

The polishing table 110 has a disk-shaped structure. The circular polishing pad 112 is attached on the polishing table 110 with an adhesive. A device (not shown) for rotating the polishing table 110 is connected to a lower face of the polishing table 110. A plurality of grooves through which slurry flows is formed in concentric circles at a planarizing surface portion of the circular polishing pad 112. A plurality of micro holes receiving the slurry is also formed at the planarizing surface portion of the circular polishing pad 112.

The polishing head 120 grasps a substrate 10 using vacuum and orients a surface of the substrate 10 to be polished over the circular polishing pad 112. The polishing head 120 contacts the surface of the substrate 10 with a planarizing surface of the circular polishing pad 112 to polish the surface of the substrate 10. The polishing head 120 also rotates the substrate 10 to improve a polishing rate while the surface of the substrate 10 contacts the circular polishing pad 112.

The slurry supply unit 130 supplies slurry at an interface between the surface of the substrate 10 and the planarizing surface of the circular polishing pad 112 during a polishing process. That is, the slurry supply unit 130 supplies the slurry on the planarizing surface of the circular polishing pad 112. The slurry supplied on the planarizing surface of the circular polishing pad 112 is then received in the micro holes (not shown). The slurry in the micro holes is provided to the interface between the surface of the substrate 10 and the planarizing surface of the circular polishing pad 112 by rotating the circular polishing pad 112. Preferably, the slurry supply unit 130 is disposed over the circular polishing pad 112 in a forward direction of the polishing head 120.

The polishing pad conditioner 140 includes a plurality of conditioning disks 142 for improving conditions of the planarizing surface of the circular polishing pad 112, a plurality of first drive units for rotating the conditioning disks 142, and an arm 146 for supporting the conditioning disks 142 disposed in a radial direction of the planarizing surface of the circular polishing pad 112. The conditioning disks 142 contact the planarizing surface of the circular polishing pad 112 during a conditioning process. The conditioning disks 142 finely abrade the planarizing surface of the circular polishing pad 112 to improve the conditions of the planarizing surface of the circular polishing pad 112.

The conditioning disks 142 are disposed in the radial direction of the planarizing surface of the circular polishing pad 112. The first drive units 144 are disposed over the conditioning disks 142. The first drive units 144 are connected to the conditioning disks 142 via a plurality of disk holders 148, a plurality of first shafts 150, a plurality of air bladders 152 and a plurality of second shafts 154.

The conditioning disks 142 are secured to the disk holders 148 using locking members 156, for example bolts. The first shafts 150 are connected to upper faces of the disk holders 148. The second shafts 154 are connected to the first drive units 144. The air bladders 152 are connected between the first shafts 150 and the second shafts 154. The air bladders 152 move the conditioning disks 142 vertically, or upward and downward, to adjust intervals between the conditioning disks 142 and the circular polishing pad 112.

Diamond particles 158 are glued on or electroplated on contact surfaces of the conditioning disks 142. The diamond particles 158 finely abrade the planarizing surface of the circular polishing pad 112 during rotation of the conditioning disks 142.

The first drive units 144 are connected to a lower portion of the arm 146. The arm 146 is disposed over the circular polishing pad 112 and is extended in the radial direction of the planarizing surface of the circular polishing pad 112. The arm 146 is connected to a second drive unit 160. The second drive unit 160 moves the conditioning disks 142 horizontally and reciprocally in the radial direction of the planarizing surface of the circular polishing pad 112. The second drive unit 160 also moves the conditioning disks 142 in a horizontal direction substantially perpendicular to the radial direction of the planarizing surface of the circular polishing pad 112. The arm 146 has a free end adjacent to a center of the polishing pad 112 and a fixed end connected to the second drive unit 160.

The second drive unit 160 moves the arm 146 horizontally and reciprocally in the radial direction of the planarizing surface of the circular polishing pad 112 while the circular polishing pad rotates so that the conditioning disks 142 uniformly improve the conditions of substantially all of the planarizing surface of the circular polishing pad 112. To clean or exchange the conditioning disks 142 or to exchange the polishing pad 112, the second drive unit 160 also moves the arm 146 in the horizontal direction substantially perpendicular to the radial direction of the planarizing surface of the circular polishing pad 112 to position the arm 146 at a side of the circular polishing pad 112.

The second drive unit 160 may include a Cartesian coordinates robot. However, persons skilled in the art may modify and vary the second drive unit 160 so that other apparatuses may be employed in the second drive unit 160. For example, the second drive unit 160 may include a selective compliance assembly robot arm (SCARA) robot. The SCARA robot moves the arm 146 horizontally and reciprocally in the radial direction of the planarizing surface of the circular polishing pad 112. The SCARA robot also rotates the arm 146 centering around the fixed end of the arm 146.

The process of conditioning the circular polishing pad 112 may be simultaneously performed with a CMP process of the substrate 10: Alternatively, the conditioning process of the circular polishing pad 112 may be separately performed after the CMP process of the semiconductor substrate 10 is carried out.

In a case where the process of conditioning the circular polishing pad 112 is separately performed after the CMP process of the semiconductor substrate 10 is carried out, a deionized water supply unit 170 is disposed over the circular polishing pad 112. The deionized water supply unit 170 includes a plurality of nozzles for supplying the deionized water on interfaces between the contact surfaces of the conditioning disks 142 and the planarizing surface of the circular polishing pad 112. Preferably, the nozzles are disposed over the circular polishing pad 112 in the forward direction of the conditioning disks 142. The deionized water is provided to the interfaces between the contact surfaces of the conditioning disks 142 and the planarizing surface of the circular polishing pad 112 by rotating the circular polishing pad 112.

Arrows shown in FIG. 1 indicate a rotation direction of the polishing table 110, a rotation direction of the polishing head 120, a rotation direction of the conditioning disks 142, a movement direction of the arm 146, and a movement direction of the second drive unit 160, respectively.

Additionally, the CMP apparatus 100 includes a control unit 180 for controlling heights of the conditioning disks 142. Though the control unit 180 is not particularly illustrated in the drawings, the control unit 180 controls an inner pressure of each of the air bladders 152 to adjust intervals between the conditioning disks 142 and the circular polishing pad 112. Variations of the inner pressure of each of the air bladders 152 may also vary a volume of each of the air bladders 152. The variations of the volume in each of the air bladders also vary the intervals between the conditioning disks 142 and the circular polishing pad 112. The control unit 180 controls operations of a compressed air supply unit (not shown) that supplies compressed air to the air bladders 152 to control the inner pressures of the air bladders 152. The compressed air supply unit includes a compressed air tank, pneumatic lines connecting the compressed air tank and the air bladders 152, and pressure control valves for controlling the inner pressures of the air bladders 152.

In addition, the control unit 180 may control operations of the first drive unit 144 and the second drive unit 160. That is, the control unit 180 controls the operations of the first drive units 144 to adjust an RPM of the conditioning disks 142. The control unit 180 also controls the operations of the second drive units 160 to move the conditioning disks 142 horizontally and reciprocally in the radial direction of the planarizing surface of the circular polishing pad 112. Thus, the circular polishing pad may be uniformly worn.

According to the present invention, the conditioning disks disposed in the radial direction of the planarizing surface of the circular polishing pad contact the planarizing surface of the rotating circular polishing pad. In addition, the conditioning disk may rotate. Thus, a conditioning rate of the polishing pad conditioner and wear uniformity of the polishing pad may be improved together.

Having thus described exemplary embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. A polishing pad conditioner, comprising:

a plurality of conditioning disks disposed in a radial direction of a planarizing surface of a circular polishing pad, the conditioning disks having contact surfaces that contact the planarizing surface of the circular polishing pad;

a plurality of first drive units connected to the conditioning disks, the first drive units rotate the conditioning disks;

an arm disposed over the circular polishing pad and extended in the radial direction of the planarizing surface of the circular polishing pad, wherein the arm supports the first drive units; and a second drive unit connected to the arm, wherein the second drive unit moves the arm in a horizontal direction substantially perpendicular to the radial direction of the planarizing surface of the circular polishing pad.

2. The polishing pad conditioner of claim 1, wherein diamond particles are attached to the contact surfaces of the conditioning disks.

3. The polishing pad conditioner of claim 1, further comprising:

a plurality of disk holders to grasp the conditioning disks;

a plurality of first shafts connected to disk holders;

a plurality of second shafts connected to the first drive units; and a plurality of air bladders connected between the first shafts and the second shafts, wherein the air bladders are used to adjust intervals between the conditioning disks and the circular polishing pad.

4. The polishing pad conditioner of claim 3, further comprising a control unit connected to the air bladders, wherein the control unit controls a volume of air within each of the air bladders.

5. The polishing pad conditioner of claim 1, wherein the second drive unit moves the arm horizontally and reciprocally in the radial direction of the planarizing surface of the circular polishing pad.

6. The polishing pad conditioner of claim 1, wherein the second drive unit comprises a Cartesian coordinates robot.

7. The polishing pad conditioner of claim 1, wherein the arm includes a fixed end and a free end, wherein the free end is disposed adjacent to a center of the planarizing surface of the circular polishing pad and the fixed end is disposed opposite to the free end of the arm, and wherein the second drive unit moves the arm horizontally and reciprocally in the radial direction of the planarizing surface of the circular polishing pad and rotates the arm centering around the fixed end of the arm.

8. The polishing pad conditioner of claim 7, wherein the second drive unit comprises a selective compliance assembly robot arm.

9. The polishing pad conditioner of claim 1, further comprising a control unit connected to the first drive units, wherein the control unit controls operations of the first drive units to adjust an RPM of the conditioning disks.

10. A chemical mechanical polishing apparatus for polishing a substrate, comprising:

a polishing table;

a circular polishing pad attached to the polishing table for polishing a surface of the substrate;

a polishing head to grasp the substrate and to orient a surface of the substrate to be polished over a planarizing surface of the circular polishing pad, wherein the polishing head contacts the surface of the substrate with the planarizing surface of the circular polishing pad during a polishing process and rotates the substrate;

a slurry supply unit supplying a slurry at an interface between the surface of the substrate and the planarizing surface of the circular polishing pad during the polishing process; and a polishing pad conditioner, comprising:

a plurality of conditioning disks disposed in a radial direction of the planarizing surface of a circular polishing pad, wherein the conditioning disks contact the planarizing surface of the circular polishing pad;

a plurality of first drive units to rotate the conditioning disks connected to the conditioning disks; and an arm to support the first drive units disposed over the circular polishing pad and extended in the radial direction of the planarizing surface of the circular polishing pad; and a second drive unit connected to the arm, wherein the second drive unit moves the arm horizontally and reciprocally in the radial direction of the planarizing surface of the circular polishing pad, wherein the second drive unit comprises a Cartesian coordinates robot.

11. The chemical mechanical polishing apparatus of claim 10, wherein each of the plurality of conditioning disks have a contact surface, and wherein the chemical mechanical polishing apparatus further comprises a deionized water supply unit for providing deionized water to interfaces between the contact surfaces of the conditioning disks and the planarizing surface of the circular polishing pad, wherein the deionized water supply unit is disposed adjacent to the polishing pad conditioner.

12. The chemical mechanical polishing apparatus of claim 11, wherein the deionized water supply unit comprises a plurality of nozzles for supplying the deionized water on the interfaces between the contact surfaces of the conditioning disks and the planarizing surface of the circular polishing pad.

13. The chemical mechanical polishing apparatus of claim 10, further comprising:

a plurality of disk holders to grasp the conditioning disks;

a plurality of first shafts connected to disk holders;

a plurality of second shafts connected to the first drive units; and a plurality of air bladders connected between the first shafts and the second shafts, wherein the air bladders are used to adjust intervals between the conditioning disks and the circular polishing pad.

14. The chemical mechanical polishing apparatus of claim 10, further comprising a control unit connected to the air bladders and the first drive units, wherein the control unit controls a volume of air within each of the air bladders and an RPM of the conditioning disks by adjusting operations of the first drive units.

15. The chemical mechanical polishing apparatus of claim 10, wherein the arm includes a fixed end and a free end, wherein the free end is disposed adjacent to a center of the planarizing surface of the circular polishing pad and the fixed end is disposed opposite to the free end of the arm, and wherein the second drive unit rotates the arm centering around the fixed end of the arm.

16. The chemical mechanical polishing apparatus of claim 15, wherein the second drive unit comprises a selective compliance assembly robot arm.

* * * * *